US006520245B2

(12) United States Patent
Pleschiutschnigg et al.

(10) Patent No.: US 6,520,245 B2
(45) Date of Patent: Feb. 18, 2003

(54) GUIDE ELEMENT OF A CONTINUOUS CASTING PLANT

(75) Inventors: Fritz-Peter Pleschiutschnigg, Duisburg (DE); Joachim Schwellenbach, Düsseldorf (DE)

(73) Assignee: SMS Schloemann-Siemag Aktiengesellschaft, Düsseldorf (DE)

( * ) Notice: Subject to any disclaimer, the term of this patent is extended or adjusted under 35 U.S.C. 154(b) by 0 days.

(21) Appl. No.: 09/843,353

(22) Filed: Apr. 26, 2001

(65) Prior Publication Data

US 2002/0005266 A1 Jan. 17, 2002

Related U.S. Application Data

(63) Continuation-in-part of application No. 09/263,585, filed on Mar. 6, 1999, now abandoned.

(30) Foreign Application Priority Data

Mar. 9, 1998 (DE) ..... 198 09 811
Sep. 12, 1998 (DE) ..... 198 41 841

(51) Int. Cl.[7] ..... B22D 11/20
(52) U.S. Cl. ..... 164/413; 164/442; 164/454
(58) Field of Search ..... 164/442, 448, 164/484, 454, 413; 72/240, 241.4, 241.6; 492/2, 6

(56) References Cited

FOREIGN PATENT DOCUMENTS

| | | | | |
|---|---|---|---|---|
| FR | 1481068 | * | 5/1967 | ..... 164/448 |
| JP | 57-31458 | * | 2/1982 | ..... 164/442 |

* cited by examiner

*Primary Examiner*—Kuang Y. Lin
(74) *Attorney, Agent, or Firm*—Friedrich Kueffner

(57) ABSTRACT

A guide element of a continuous casting plant, particularly a continuous casting plant for thin slabs, for guiding a metal strip in a strand guiding direction includes a pair of guide rollers which are located opposite each other relative to the metal strip and form a roller gap. The pair of guide rollers is provided with an adjusting device for adjusting a crown of the roller gap.

10 Claims, 2 Drawing Sheets

GUIDE ELEMENT OF A CONTINUOUS CASTING PLANT

CROSS REFERENCE TO RELATED APPLICATIONS

This application is a continuation-in-part application of U.S. Patent Application Ser. No. 09/263,585 filed Mar. 6, 1999 now abandoned.

BACKGROUND OF THE INVENTION

1. Field of the Invention

The present invention relates to a guide element of a continuous casting plant, particularly a continuous casting plant for thin slabs, for guiding a metal strip in a strand guiding direction. The guide element includes a pair of guide rollers which are located opposite each other relative to the metal strip and form a roller gap.

2. Description of the Related Art

When continuously casting slabs, particularly at casting speeds of between 1.0 m/min and 10 m/min, it is of great importance for the casting safety as well as for the rolling process that the strand travels centrically through the strand guide section which is composed predominantly of rollers.

This centric travel of the strand during its solidification leads to

- a safe casting pattern, i.e., strand ruptures in the mold area are avoided or suppressed, and
- a symmetrical strand size which is important for producing a good hot strip profile with a crown of 1% and a good flatness.

This centric travel of the slab and the resulting high casting safety or symmetrical slab shape becomes important superproportionately with increasing casting speed and decreasing slab thickness.

Experience has shown that the control of a symmetrical crown or a symmetrical slab profile becomes more important as the thickness of the slab decreases or the width/thickness ratio of the slab increases because the width of the rolling stock does not further increase when the width/thickness ratio is about 100/1.

Accordingly, in the case of a thin slab having a solidification thickness of, for example, 150 to 40 mm, the control of the solidification profile becomes more important than for a standard slab of a thickness of 200 mm.

To be mentioned as prior art in this connection are the following patent applications:

PCT/DE 95/00 094 (WO 95/20 448)

PCT/DE 95/00 093 (WO 95/20 446)

PCT/DE 95/00 096 (WO 95/20 447)

In these applications, the roller strand guide sections have a concave shape.

In the two patent applications mentioned first, the rollers have a concave circumferential line, wherein the smallest diameter occurs in the middle of the roller.

In the third patent application PCT/DE 95/00 096, the concave roller strand guide section is formed by a bending of at most 8% which occurs under load.

This type of strand concavity cannot simultaneously meet the requirements of the strand in the area of solidification and after the solidification. The particular reasons for this are, for example, the reduction of the strand thickness during the solidification between the mold outlet and the final solidification, which in this technical field is known as continuous casting with liquid core, also called cast rolling or liquid core reduction. In this area of the solidification of the strand, the strand shell makes complete contact with the roller profile; this is caused by the prevailing ferrostatic pressure or the steel column present between the meniscus and the observed strand shell point.

After the last solidification point or after the final solidification, the strand is frozen in its shape, for example, with a profile whose thickness advantageously is 1% greater in the middle of the strand as compared to the narrow side wall areas, wherein the profile does not further change with respect to this percentage over the further path of the strand to the end of the strand guide section. The only change of the strand geometry occurs as a result of the shrinkage of the entire strand which is due to cooling.

The strand guide section must follow this shrinkage of the strand after the full solidification in order to ensure that the rollers have contact with the strand and, thus, the rollers continue to rotate.

SUMMARY OF THE INVENTION

Therefore, it is the primary object of the present invention to further develop a guide element of a continuous casting plant in such a way that the strand concavity can be adjusted in an optimum manner in the area of the solidification as well as after the solidification.

In accordance with the present invention, the pair of guide rollers is provided with an adjusting device for adjusting a crown of the roller gap.

As a result of this configuration, the roller gap can be adjusted to a defined crown which can be freely preselected as required.

By constructing the adjusting device to be capable of being operated in a pressure-controlled as well as a position-controlled manner, it is possible to ensure in a particularly simple manner the shaping in the strand portion with liquid core, on the one hand, and the roller contact in the fully solidified metal strip, on the other hand. In particular, the so-called liquid core reduction can be easily effected.

If at least one of the guide rollers has a center bearing, for example, because the guide roller is constructed as a divided guide roller, the adjusting device preferably is to be configured to act on the center bearing.

If, on the other hand, at least one of the guide rollers is constructed as a continuous guide roller, the adjusting device should act through at least one support roller on the at least one guide roller.

The support roller acts on the guide roller in a particularly reliable manner if the support roller is turned relative to the guide roller by a support angle which is different from zero.

In another embodiment, the adjusting device can also act through an additional support roller on the at least one guide roller, wherein the support roller and the additional support roller are arranged above and below the guide roller as seen in the strand guiding direction.

In accordance with another feature, the guide rollers and the adjusting device are mounted in frames which are capable of absorbing tension and pressure and the frames are adjustably tensioned relative to each other. This results in a particularly precise adjustability of the crown and of the total roll gap.

In accordance with another feature, at least one of the frames has a crossbeam for connecting the frame to a basic segment guide member through a fastening device which is arranged centrically relative to the crossbeam. As a result, the frame can expand symmetrically and unimpededly, for example, when heated.

The adjustment of the roller gap between the guide rollers is preferably effected by means of a hydraulic cushion. As is the case with the adjusting device, the hydraulic cushion also is preferably adjustable in a pressure-controlled and position-controlled manner.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

DESCRIPTION OF THE PREFERRED EMBODIMENTS

Figure 1:
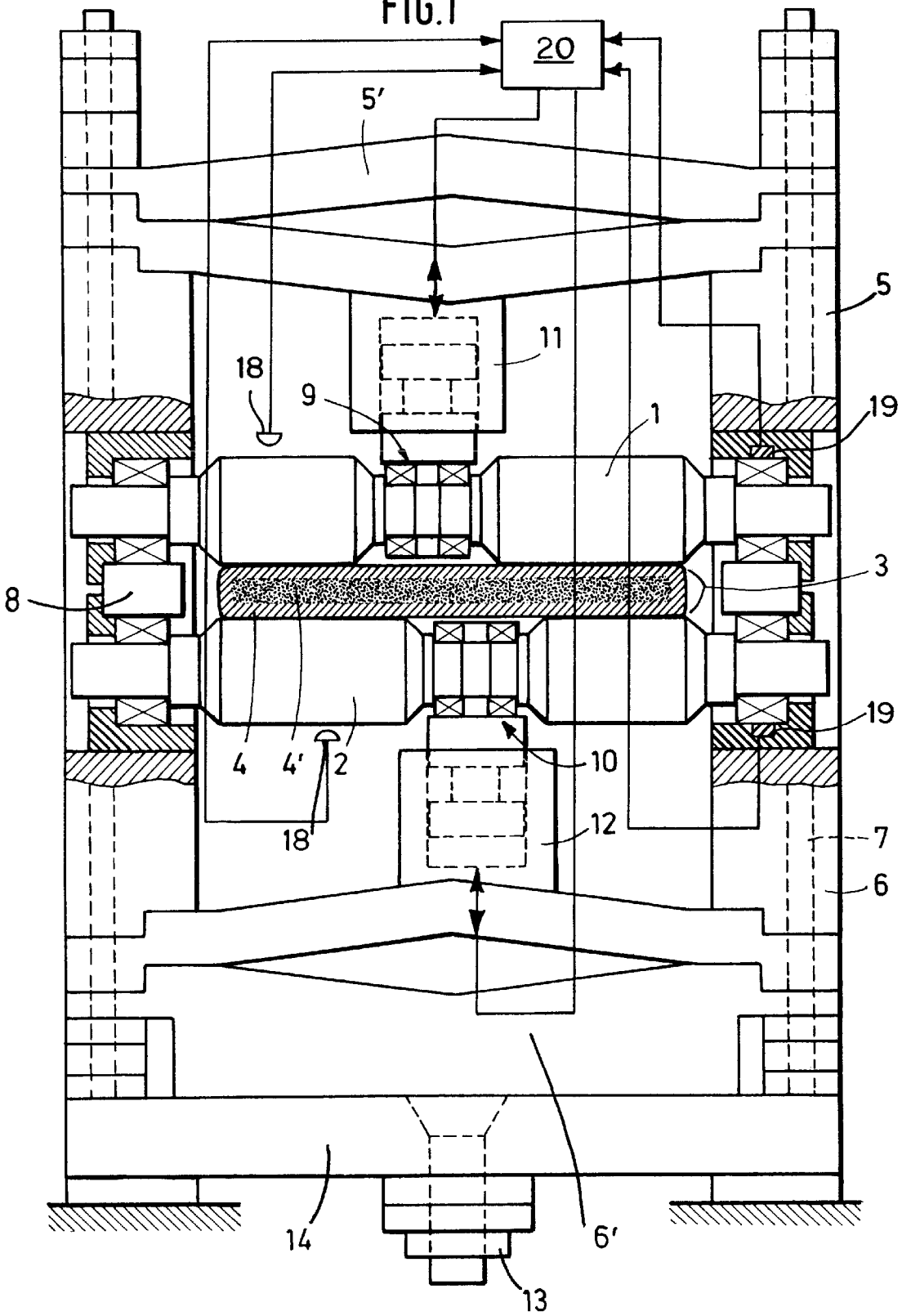
FIG. 1 is a partially sectional view of a guide element according to the present invention.

As illustrated in FIG. 1, a guide element of a continuous thin slab casting plant includes a pair of guide rollers 1, 2. The guide rollers 1, 2 form a roll gap 3 and are located opposite each other relative to a metal strip 4 to be guided. The metal strip 4 has a thickness of between 40 and 100 mm, for example, 50 mm. The metal strip 4 can be guided in a strand guiding direction x by means of the guide rollers 1, 2.

The guide rollers 1, 2 are mounted in frames 5, 6. The frames 5, 6 are constructed so as to be capable of absorbing tension and pressure and are tensioned or clamped together by means of tension rods 7. A hydraulic cushion 8 is arranged between the frames 5 and 6. The frames 5 and 6 can be adjusted relative to each other by means of this hydraulic cushion 8.

As further illustrated in FIG. 1, the guide rollers 1, 2 are constructed as divided guide rollers. Accordingly, the guide rollers are provided with center bearings 9, 10. Hydraulic cylinder units 11, 12 which act on the center bearings 9, 10 are mounted on the crossbeams 5', 6' in the middle thereof.

The crossbeams 5', 6' are components of the respective frames 5 and 6. The crown of the roller gap 3 can be adjusted by the hydraulic cylinder units 11, 12. Consequently, the hydraulic cylinder units 11, 12 form an adjusting device for adjusting the crown of the roller gap 3 formed by the pair of guide rollers 1, 2. In this manner, the crown of the guided metal strip 4 can be adjusted to, for example, 1% or 2%, in a specifically targeted manner.

The hydraulic cylinder units 11, 12 can be operated in a pressure-regulated as well as a position-regulated manner. The adjusting device includes pressure sensors 19 and position sensors 18 for sensing the pressure acting on and the position relative to the guide rollers. A control unit 20 is provided for controlling the pressure and the position of the hydraulic cylinder units 11, 12 of the adjusting device. Similarly, the hydraulic cushion 8 can also be adjusted in a pressure-regulated and position-regulated manner. Of course, other adjusting elements, for example, electromechanical elements, can be used instead of hydraulic cylinder units 11, 12. Instead of regulating means, it is also possible to provide controls for pressure and position.

When the metal strip 4 is not yet fully solidified, i.e., has a liquid core 4', the adjusting device is operated by position control and the hydraulic cushion 8 is adjusted by position control. As a result of the ferrostatic pressure caused by the liquid core 4', the metal strip 4 adjust itself to the adjusted roller gap 3. Specifically, the position controls make possible an adjustment of a defined liquid core reduction as well as a defined crown. The reduction of the strand thickness during the solidification of the metal strip 4 may be up to 60%.

When the metal strip 4 is fully solidified, i.e., no longer has a liquid core 4', the adjusting device is preferably operated by pressure control. In that case, the hydraulic cushion 8 is also preferably adjusted by pressure control. Consequently, the roller gap 3 now adapts to the solidified metal strip 4 and a further rotation of the guide rollers is ensured. If a so-called soft reduction should be desired, this type of control makes it possible to achieve appropriately high desired pressure values.

The lower crossbeam 6' as seen in FIG. 1 has a fastening device 13. The fastening device 13 is arranged centrically relative to the crossbeam 6'. The crossbeam 6' and, thus, the frames 5, 6 are connected by means of the fastening device 13 to a basic segment guide member 14. The fastening device 13 may operate hydraulically or mechanically. Consequently, the crossbeam 6' of the frame 6 secured in this manner can expand symmetrically, for example, in the case of thermal heating. This prevents mechanical tensions.

Figure 2:
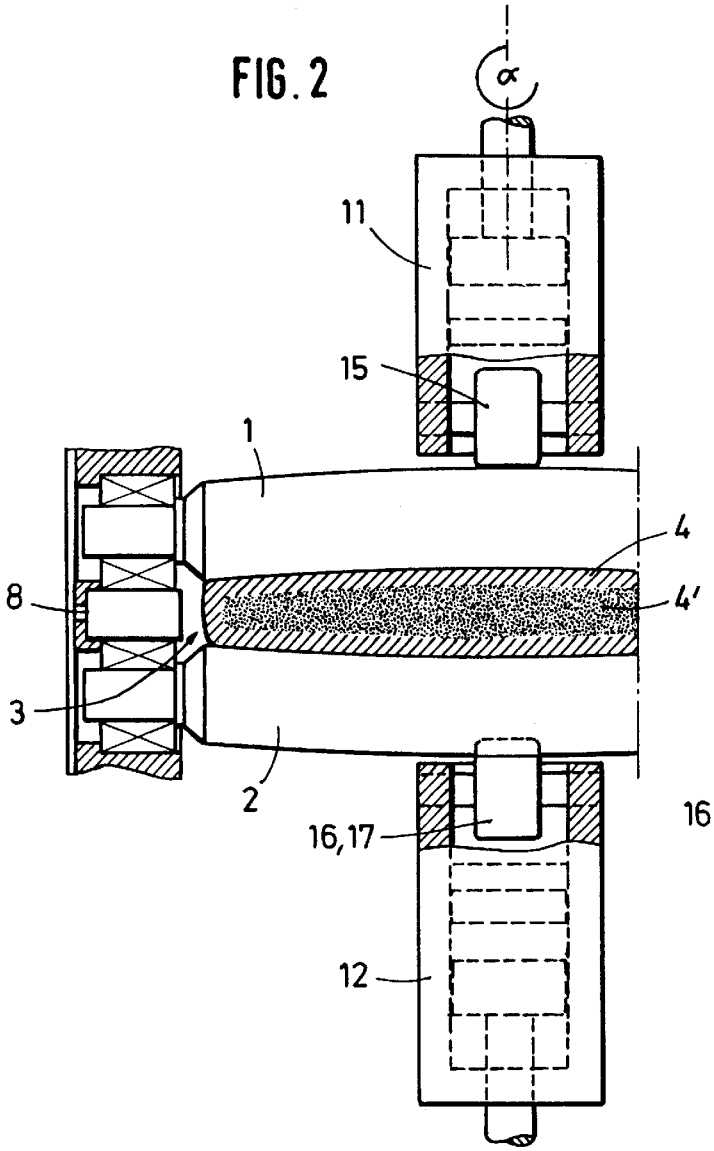
FIG. 2 is a partially sectional view of guide rollers with support rollers in the strand guiding direction.
Figure 3:
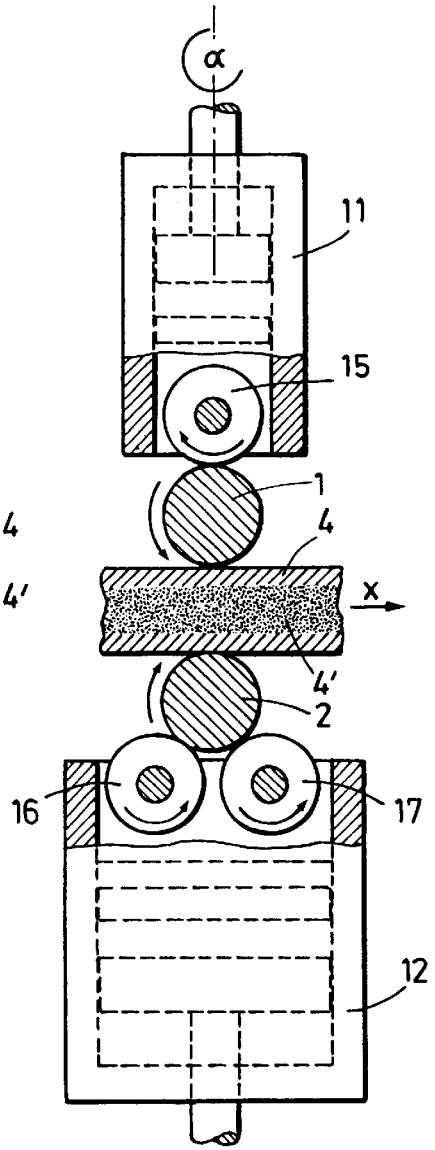
FIG. 3 is a side view, partially in section, of the guide roller arrangement of FIG. 2.

As illustrated in FIGS. 2 and 3, the guide rollers 1, 2 may also be constructed as continuous guide rollers 1, 2. In that case, the appropriate hydraulic cylinder unit 11, 12 acts through at least one support roller 15, 16 on the respective guide roller 1, 2.

If, as is the case with the upper guide roller 1, the support roller 15 is the only support roller which acts on the guide roller 1 the support roller 15 preferably is turned by a support angle $\alpha$ about a vertical axis relative to the respective guide roller 1. This turning of the support roller 15 by the support angle $\alpha$ serves to stabilize the position of the support roller 15. The support angle $\alpha$ should be within a range of up to a maximum of 10°.

If, as is the case with the lower guide roller 2, the adjusting device acts through an additional support roller 17 on the respective guide roller 1, it is not necessary to turn the support roller 16 and the additional support roller 17. This is because in that case the support roller 16 can be arranged upstream of the guide roller 2 as seen in the strand guiding direction x, while the additional support roller 17 is arranged downstream of the guide roller 2.

While specific embodiments of the invention have been shown and described in detail to illustrate the inventive principles, it will be understood that the invention may be embodied otherwise without departing from such principles.

We claim:

1. A guide element of a continuous casting plant, particularly a thin slab casting plant, for guiding a metal strip in a strand guiding direction, the guide element comprising at least one pair of guide rollers located opposite each other relative to the metal strip and defining a roller gap therebetween, further comprising an adjusting device for the pair of guide roller for adjusting a crown of the roller gap the adjusting device comprising pressure sensors and position sensors for sensing a pressure acting on and a position relative to the guide rollers, and control elements for controlling the pressure and the position of the adjusting device, wherein the adjusting device is configured to be operated in at least one of a pressure-controlled and a position-controlled manner.

2. The guide element according to claim 1, wherein at least one of the guide rollers has a central bearing, and wherein the adjusting device is mounted to act on the center bearing.

3. The guide element according to claim 2, wherein the at least one guide roller is a divided guide roller.

4. The guide element according to claim 1, wherein at least one of the guide rollers is a continuous guide roller, further comprising a support roller mounted such that the adjusting device acts through the at least one support roller on the at least one guide roller.

5. The guide element according to claim 4, wherein the at least one support roller is mounted so as to be turned relative to the at least one guide roller by a support angle which differs from zero.

6. The guide element according to claim 5, further comprising an additional support roller mounted between the adjusting device and the at least one guide roller, wherein the support roller is arranged upstream of the at least one guide roller in the strand guiding direction, and wherein the additional support roller is arranged downstream of the at least one guide roller in the strand guiding direction.

7. The guide element according to claim 1, further comprising frames capable of absorbing tension and pressure, the guide rollers and the adjusting device being mounted in the frames, wherein the frames are mounted so as to be adjustably tensioned relative to each other.

8. The guide element according claim 7, wherein at least one of the frames comprises a crossbeam for connecting the frame to a basic segment guide member through a fastening device mounted centrally relative to the crossbeam.

9. The guide element according to claim 7, wherein the frames are adjustable relative to each other through a hydraulic cushion.

10. The guide element according to claim 9, wherein the hydraulic cushion is configured to be adjustable in a pressure-controlled as well as position-controlled manner.

* * * * *